US006037021A

United States Patent [19]

Koo

[11] Patent Number: 6,037,021

[45] Date of Patent: Mar. 14, 2000

[54] ARTIFICIAL FOLIAGE ARTICLES

[75] Inventor: Yue Sin George Koo, Kowloon, The Hong Kong Special Administrative Region of the People's Republic of China

[73] Assignee: United Chinese Plastics Products Co., Ltd., Hunghom, The Hong Kong Special Administrative Region of the People's Republic of China

[21] Appl. No.: 09/164,179

[22] Filed: Sep. 30, 1998

[51] Int. Cl.[7] ..... A47G 33/00; A47G 33/06

[52] U.S. Cl. ..... 428/10; 428/18; 428/20

[58] Field of Search ..... 428/10, 18, 20

[56] References Cited

U.S. PATENT DOCUMENTS

| | | | |
|---|---|---|---|
| 4,590,105 | 5/1986 | Shaffer | 428/20 X |
| 4,774,113 | 9/1988 | Shaffer | 428/18 |
| 5,789,043 | 8/1998 | Law et al. | 428/10 |

*Primary Examiner*—Timothy M. Speer
*Assistant Examiner*—Bryant Young
*Attorney, Agent, or Firm*—Cohen, Pontani, Lieberman & Pavane

[57] ABSTRACT

An artificial foliage article such as Christmas trees comprising one or more branch stems 4 in the form of plastics covered metal wires and a plurality of foliage-bearing sub-branches 10 connected to the branch stem or stems 4, each sub-branch 10 having an associated connector 12 which defines an aperture 14 therein to allow the sub-branches 10 to be push-fitted onto the branch stem 4.

12 Claims, 6 Drawing Sheets

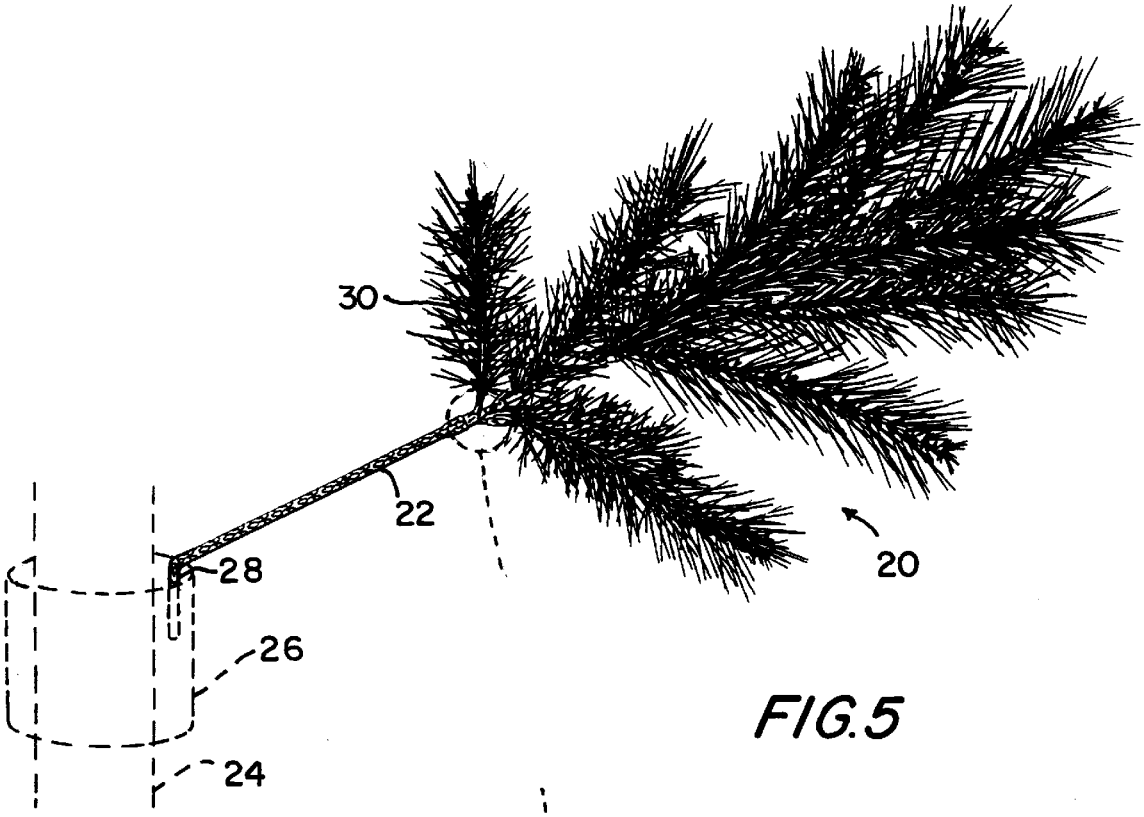
FIG.5
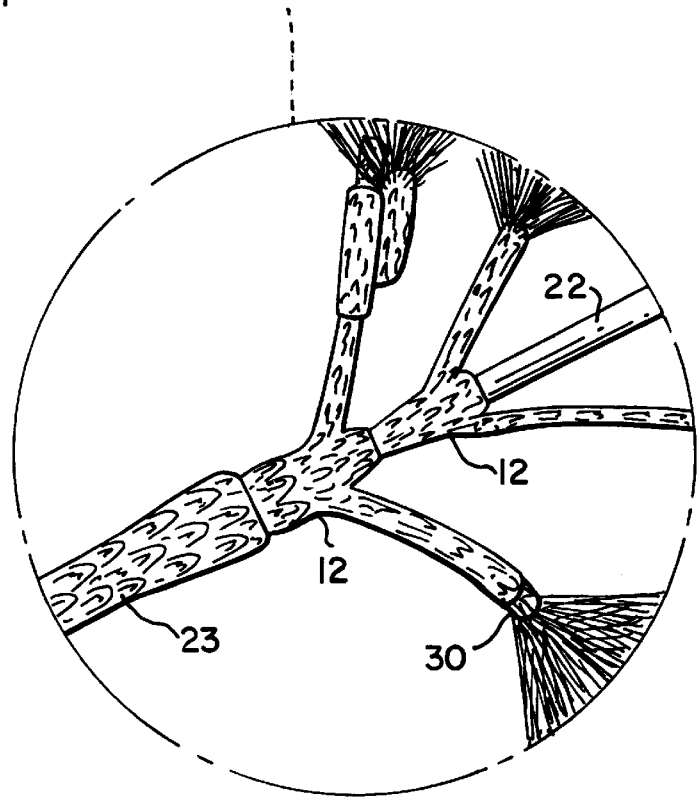

ARTIFICIAL FOLIAGE ARTICLES

BACKGROUND OF THE INVENTION

The present invention relates to artificial foliage articles such as bushes or trees, garlands or wreaths or similar, for use preferably as Christmas decorations, and to branches used to form part of an artificial tree.

In conventional artificial trees of the type as used for Christmas trees, the branches of the tree generally comprise a central wire which may be a solid wire to which sub-branches which also comprise metal wires are attached. The stems of the main branches and the sub-branches may be covered in a thread wound tightly about the branch many times so that this both covers the central wires and serves to attach the sub-branches onto the main branches.

In another arrangement, the sub-branches have stems in the form of twisted metal wires which are twisted together with the main branch stem at the junctions thereof.

In items such as garlands and wreaths a somewhat different structure is generally provided. These comprise a main stem in the form of central wire which is held into the desired shape by securing it on a support frame, the sub-branches being attached onto the central wire. The central wire may be formed of two individual wire strings which are twisted together. Each sub-branch is itself formed of a relatively short length of twisted wire, with many thin lengths of plastics material held therebetween to give the coniferous "needles". The wire of the sub-branch is looped in a U-turn around the central wire prior to its twisting so that this too is held within the twisted strings.

Whilst these attachment methods can adequately secure the sub-branches onto the tree or the wreath, they are relatively expensive and time-consuming to produce. Moreover, they are relatively inflexible in that once a sub-branch has been positioned at a particular place it is impossible to move its position.

The present invention seeks to provide a structure applicable to items such as trees, bushes, wreaths and garlands, and similar articles which overcomes these drawbacks.

SUMMARY OF THE INVENTION

In a first aspect, the invention resides in an artificial foliage article comprising one or more branch stems and a plurality of foliage-bearing sub-branches connected to the branch stem or stems, each sub-branch having an associated connector which defines an aperture therein to allow the sub-branches to be push-fitted onto the branch Stem.

This arrangement allows for greatly simplified assembly and thereby reduced manufacturing time and cost, and in addition provides a structure whereby the sub-branches can be positioned as desired.

In a further aspect the invention resides in an artificial tree or bush comprising a plurality of branch stems and a plurality of sub-branches which are joined at proximal ends thereof to the branch stems, the proximal ends being formed with a connector portion defining an aperture therethrough which allows the sub-branches to be push-fitted onto the branch stems.

In a further aspect the invention resides in an artificial garland or wreath having at least one central stem to which are attached a plurality of sub-branches, the sub-branches being formed with a connector portion defining an aperture therethrough which allows the sub-branches to be push-fitted onto the steam.

In the preferred embodiments the branch stem, or central stem comprises a metal wire covered in plastics. The connector is preferably comprised of a moulded plastics element, which is formed by injection moulding onto the previously-formed sub-branch.

The free ends of the branch stems may be provided with end pieces to cover the exposed metal wire end.

BRIEF DESCRIPTION OF THE DRAWINGS

Embodiments of the invention are now described, by way of example only, with reference to the following drawings in which:

FIG. 5 shows a branch in accordance with a second embodiment of the invention, with an enlarged view in the inset thereto;

DETAILED DESCRIPTION OF THE PREFERRED EMBODIMENTS

Figure 1:
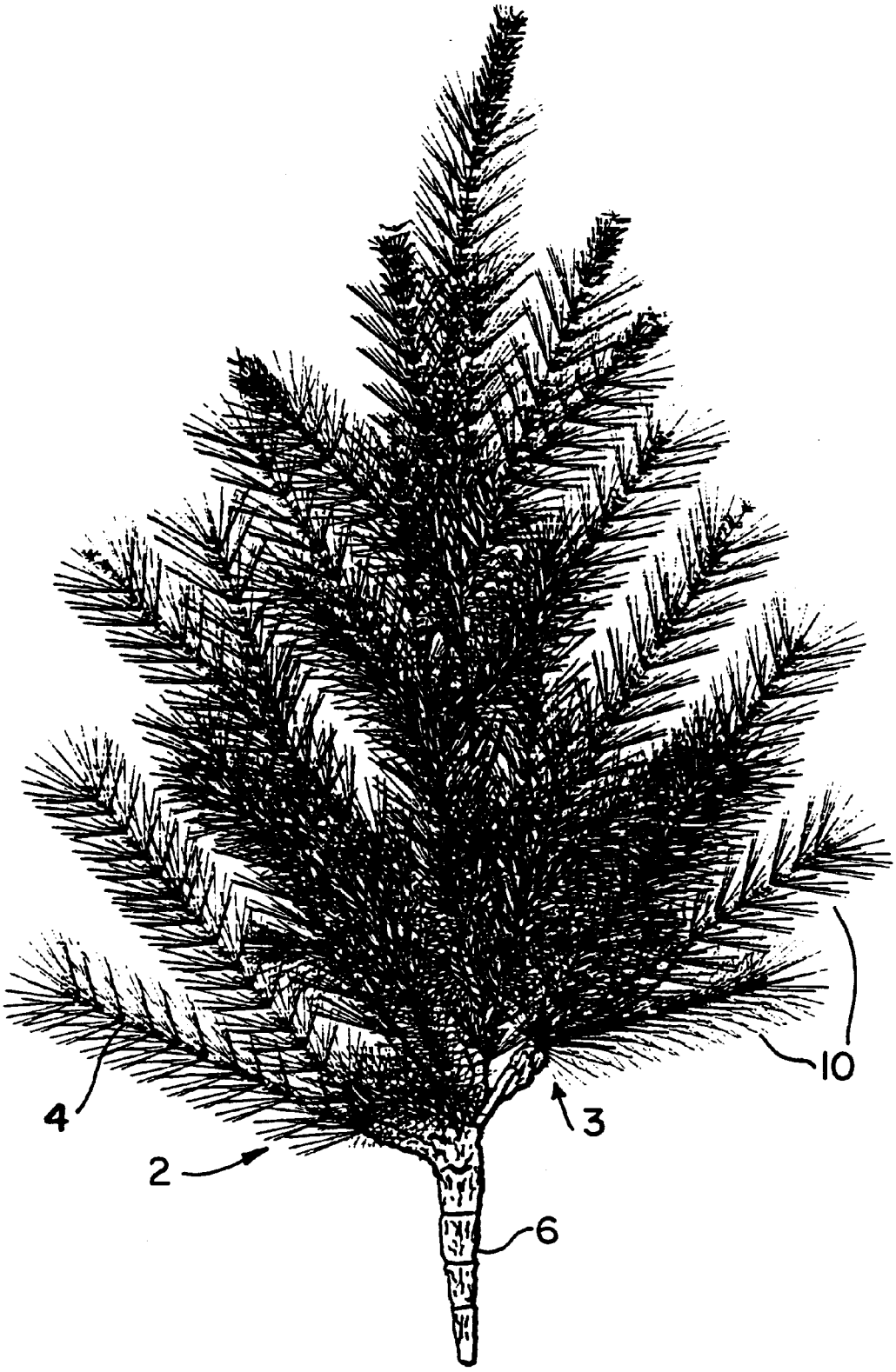
FIG. 1 shows a bush or small tree in accordance with a first embodiment of the invention.
Figure 2:
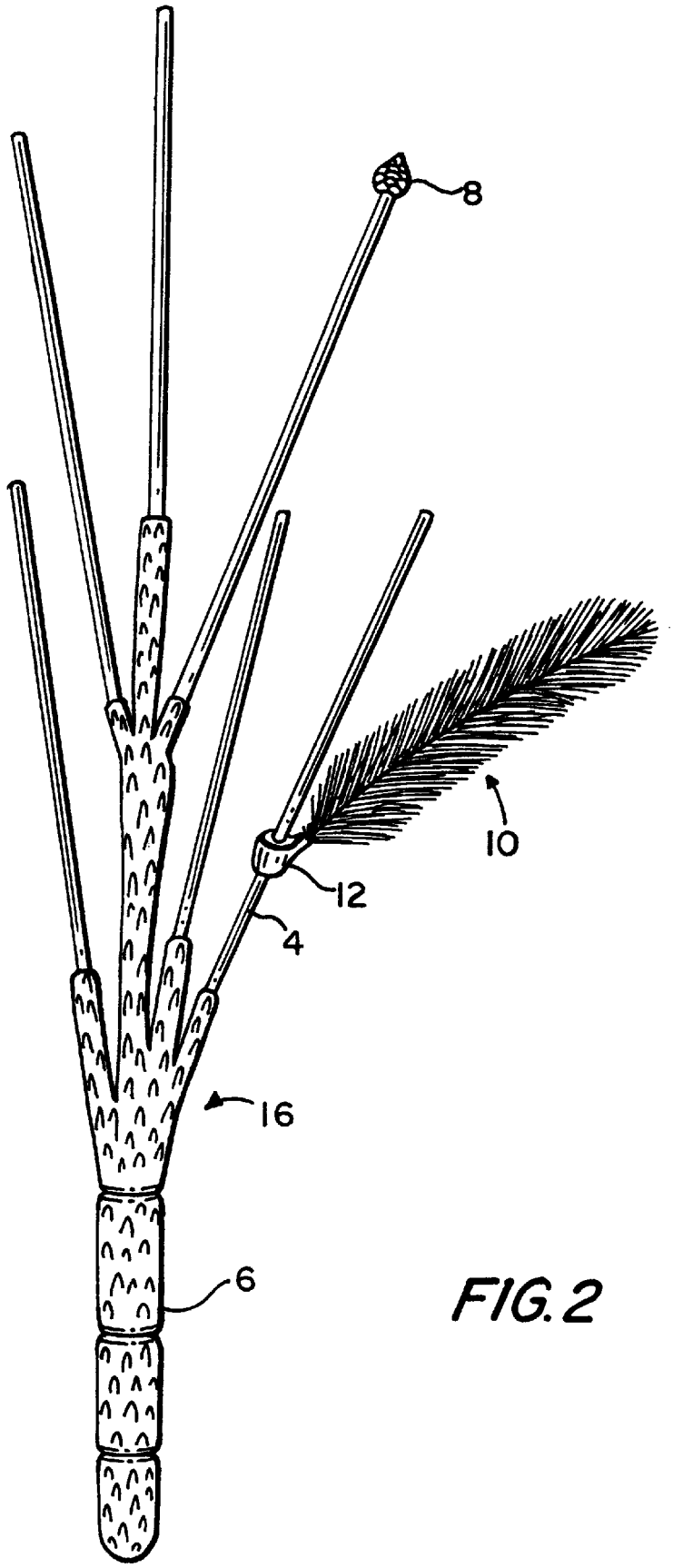
FIG. 2 shows the stem and branches of the bush or tree of the embodiment of FIG. 1.

As shown in FIGS. 1 and 2, in the first embodiment the invention resides in a bush or small tree 2. The bush 2 has a number of branches 3 which have branch stems 4 which are joined together at the lower ends thereof in a single plastics moulded trunk 6. The branch stems 4 each comprise a single metal wire over which a plastic coating has been moulded. Ends of the wire may be provided with end pieces 8 to protect the user from the possibly sharp branch end or bare end of the wire. These end pieces are preferably formed of moulded plastics pieces in the shape of buds or other suitable natural shapes for decorative purposes.

A number of foliage-bearing sub-branches 10 are connected to the branch stems 4. Each sub-branch comprises a pair of metal wires twisted together to which are attached to a large number of thin plastics strips, generally formed of PVC, which extend between the pair of metal wires so that they are held between the metal wires as they are twisted, and which resemble the needles of a coniferous tree. These are preferably of green colour. It may be arranged that different shades of colour are used at different parts of the sub-branches to more closely resemble a real tree.

Short strips of a brown plastics material may additionally be used for added realism.

Figure 3:
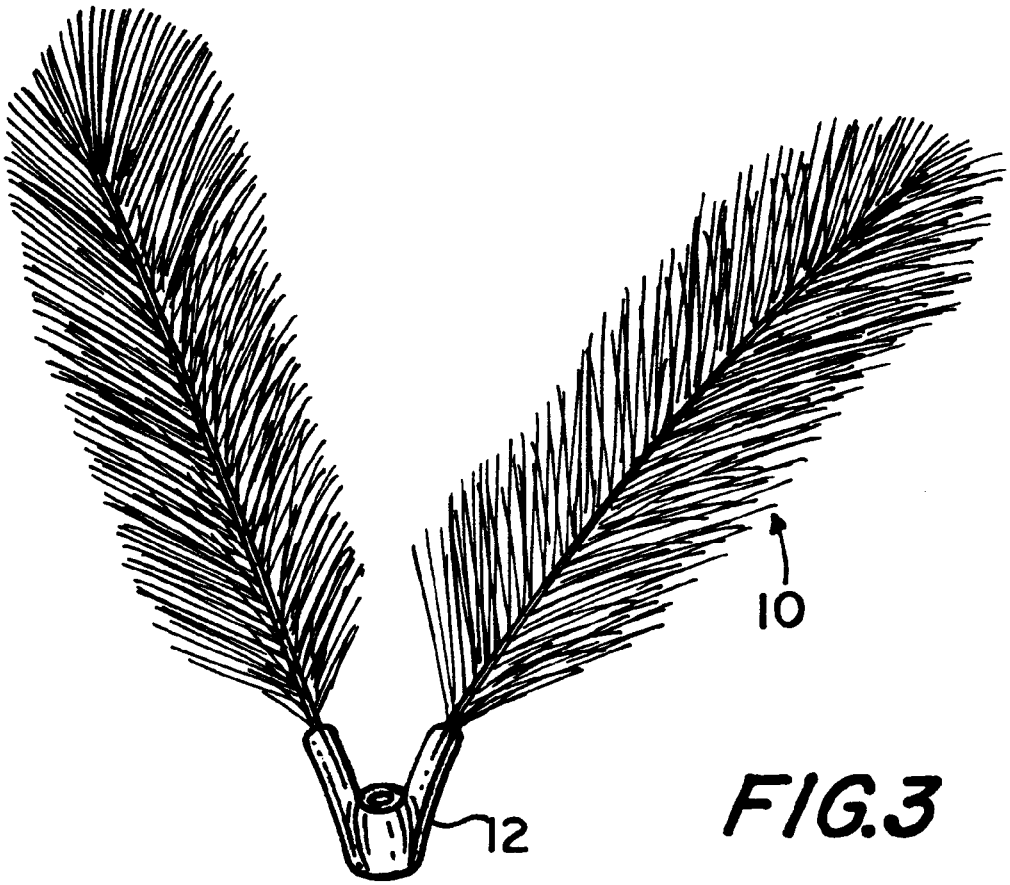
FIG. 3 shows a pair of sub-branches with a connector piece therebetween.
Figure 4:
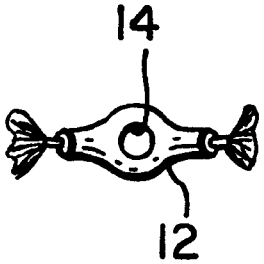
FIG. 4 is an end view of the connector piece of FIG. 3.

At the proximal or lower ends of the sub-branches where they join the branch stems 4 the twisted wires extend into a connector 12 as seen in FIG. 3 which is a moulded plastics piece which has a central aperture 14 (best seen in FIG. 4) through which in use the branch stems 4 extend. This arrangement allows the sub-branches 10 to be slid onto the branch stems 4 and positioned as desired when the tree is assembled. Each connector 12 may be joined to a single sub-branch 10 (as in FIG. 2), or to a pair of sub-branches which extend in opposition directions from the connector 12 as is shown in FIG. 3, or alternatively may be connected to a greater number of sub-branches if desired.

FIG. 2 shows the bush of FIG. 1 with the sub-branches 10 and end pieces 8 removed (with the exception of a single sub-branch 10), to show only what is referred to as the "frame" 16, comprising the trunk 6 and branch stems 4 only. The frame 16 is formed by inserting the bare metal wires into an appropriately-shaped injection mould, which moulds the central trunk portions over the lower ends of the wires to connect them and hold them in place, and moulds a thin coating of plastics over the lengths of the wires.

The frame 16 of FIG. 2 may alternatively be formed in two moulding steps; for example, the upper three branch stems and upper trunk part may be moulded in a first moulding step, and the resultant of this first step placed in a second mould in which the lower trunk part is moulded, with the lower branch stems extending into the lower trunk part, and at which the lower branch stems are coated in the plastics. Larger trees or bushes in particular may be advantageously moulded in a multi-step procedure.

To form the sub-branches 10 with the connectors 12, after twisting of the metal wires with the needle-like plastics material, the lower ends of the sub-branches are inserted into an injection moulding cavity which moulds the plastics connector 12 onto the end of the sub-branch.

Turning now to FIG. 5, this shows a branch 20 which is used to form part of a larger artificial tree such as a Christmas tree, which branch 20 constitutes a second embodiment of the invention. The branch 20 is connected to a tree trunk 24 which is indicated in outline in the Figure. This is preferably a hollow metal pole or wooden pole as is conventional in the art. The branch 20 has a central longitudinal wire portion 22 constituting the branch stem which is coated with a plastics material. A lower region may also be moulded with a "natural" pattern as at 23 in the enlarged inset to FIG. 5. At the lower end of the branch, the wire portion is adapted to be connected to the central trunk 24. Conventional fixing means may be provided for attaching the branch 20 to the trunk 24; for example, the trunk may be provided with a collar part 26 having a generally longitudinal aperture into which a bent end 28 of the branch is inserted. Alternatively, a hinge arrangement may be provided where the end of the branch 20 is formed with a wire loop (instead of the bent portion 28) through which a pin which extends between opposed Jaws on a collar portion of the trunk is inserted. Other conventional attachment methods may alternatively be used.

The branch 20 is provided with sub-branches 30 of similar construction to the sub-branches 10 of the first embodiment including connectors 12, and which can be slid onto the branch 20 and positioned as desired.

Figure 6:
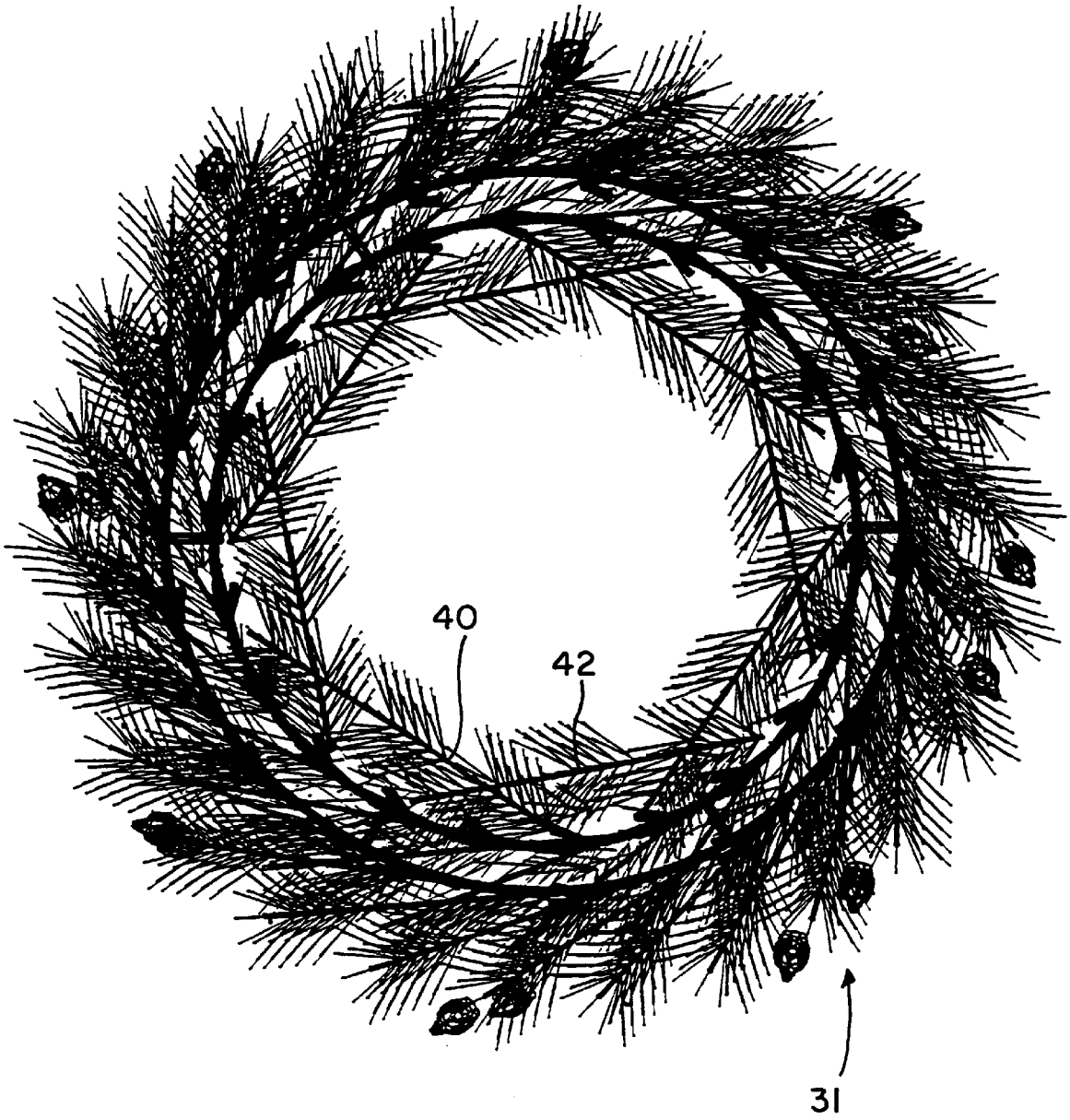
FIG. 6 shows a garland or wreath in accordance with a third embodiment of the invention.
Figure 7:
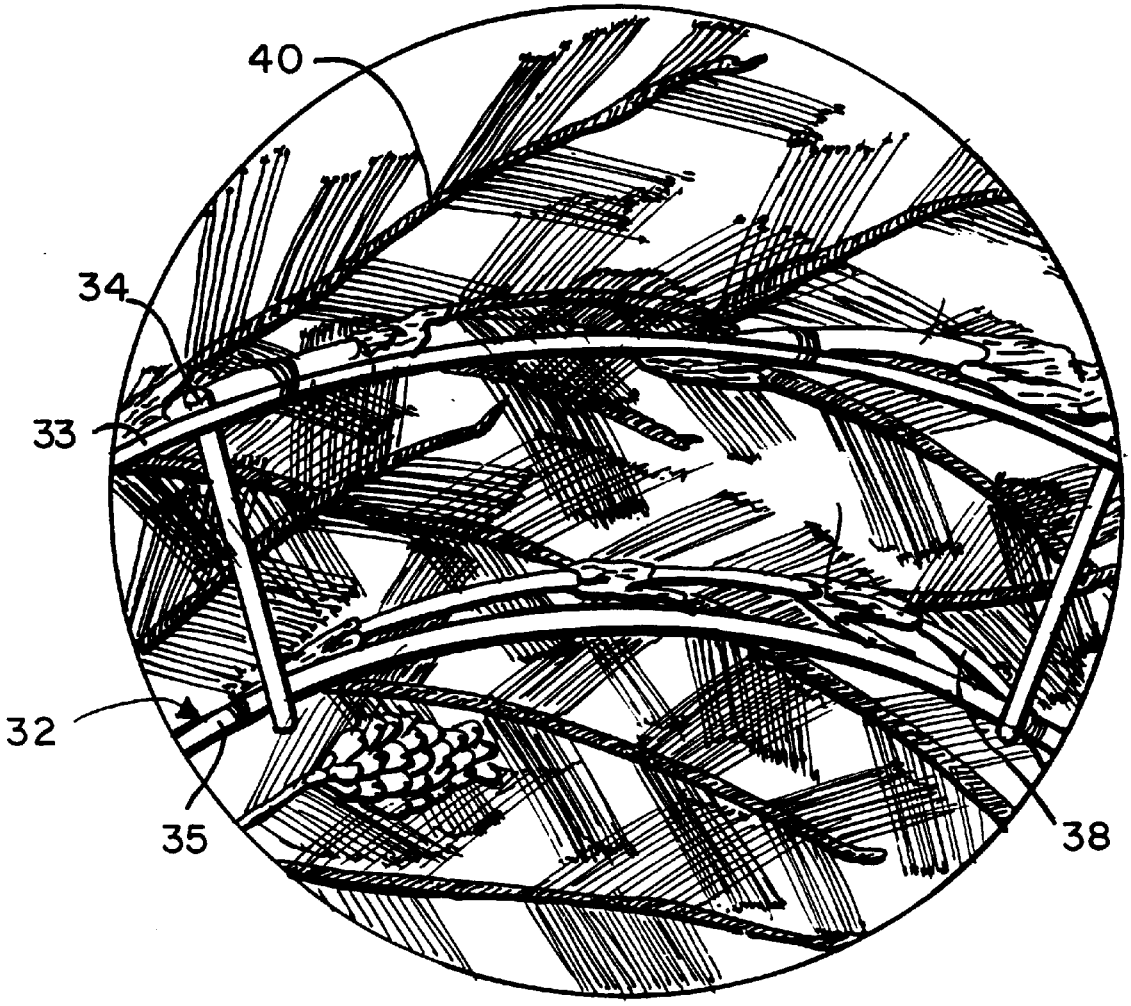
FIG. 7 is an enlarged view of a portion of the garland or wreath of FIG. 6.

In the third embodiment of the invention, the same means of securing sub-branches is utilized in a garland or wreath. As shown in FIG. 6, the garland 31 has a support frame 32 which comprises a pair of metal wire rings 33, 35 connected together by a number of crosspieces 34. The garland has a pair of central stems 36, 38 which comprise lengths of wire coated by plastics and secured to respective rings 33, 35 by means of a metal tie or other simple fixing. Onto these stemns 36, 38 are attached the sub-branches 40 which are equivalent to the sub-branches of the first and second embodiments, that is having connecting portions 42 which are slid onto the stem 36, 38, as better seen in the enlarged view of FIG. 7.

The garland may comprise only a single central stem which may be secured on a support frame in the form of a single wire ring. Alternatively, the support frame may be omitted altogether, and the user may simply attach the central stem or stems to any suitably available fixing.

Although the invention has been described with regard to Christmas trees or bushes, garlands and wreaths, the invention is applicable to many other decorative items comprising artificial foliage where sub-branches are joined to main branches or stems, such as picks, sprays, candle-rings, swags, teardrops, centrepieces, wall and door pieces and mantle structures.

All of these arrangements allow the sub-branches to be readily connected to the main branches in a simple yet effective manner, which simplifies the assembly and thereby reduces the cost of the article. Moreover, the arrangement affords flexibility in that the exact positioning of the sub-branches can be adjusted, either on assembly or by the end user as desired.

I claim:

1. An artificial foliage article, comprising:

a branch stem; and a plurality of foliage bearing sub-branches releasably connected to said branch stem, each of said plural sub-branches having a connector defining an aperture sized for push-fitting, releasable receipt of said branch stem in said aperture to thereby selectively slidably position said each of said plural sub-branches on said branch stem at a user-determined position along said branch stem.

2. The artificial foliage article according to claim 1, wherein said branch stem comprises a metal wire covered in plastics.

3. The artificial foliage article according to claim 1, wherein said connector comprises molded plastics.

4. The artificial foliage article according to claim 2, wherein said branch stem comprises a free end having an end piece.

5. An artificial tree or bush, comprising:

a plurality of branch stems; and a plurality of sub-branches, each one of said plural sub-branches having a proximal end comprising a connector portion defining an aperture therethrough sized for push-fitting, releasable receipt of one of said said plural branch stems in said aperture to thereby selectively slidably position said each of said plural sub-branches on said one of said plural branch stems at a user-determined position along said one of said plural branch stems.

6. The artificial tree or bush according to claim 5, wherein each one of said plural branch stems comprises a metal wire coated in plastics material.

7. The artificial tree or bush according to claim 5, further comprising a single moulded trunk part from which said plural branch stems extend.

8. An artificial garland or wreath, comprising:

at least one central stem; and a plurality of sub-branches, each one of said plural sub-branches having a connector portion defining an aperture therethrough sized for push-fitting, releasable receipt of said at least one central stem in said aperture to thereby selectively slidably position said each of said plural sub-branches on said at least one central stem at a user-determined position along said at least one central stem.

9. The artificial garland or wreath according to claim 8, wherein said central stem comprises a metal wire coated with a plastics material.

10. A branch for attachment to an artificial tree, comprising:

a central branch stem; and a plurality of sub-branches attached to said central branch stem, each one of said plural sub-branches comprising a connector portion defining an aperture therethrough sized for push-fitting, releasable receipt of said central branch stem in said aperture to thereby selectively slidably position said each of said plural sub-branches on said central branch stem at a user-determined position along said central branch stem.

11. The branch according to claim 10, wherein said central branch stem comprises a metal wire coated in plastics material.

12. An artificial Christmas tree comprising a central trunk and a plurality of branches, wherein each of said plural branches comprises a central branch stem and a plurality of sub-branches attached to said central branch stem, each one of said plural sub-branches comprising a connector portion defining an aperture therethrough sized for push-fitting, releasable receipt of said central branch stem in said aperture to thereby selectively slidably position said each of said plural sub-branches on said central branch stem at a user-determined position along said central branch stem.

* * * * *